US009222471B2

(12) United States Patent
Liao

(10) Patent No.: US 9,222,471 B2
(45) Date of Patent: Dec. 29, 2015

(54) STRUCTURE OF PUMP

(71) Applicant: Lih Yann Industrial Co., Ltd., Taichung (TW)

(72) Inventor: Po Lin Liao, Taichung (TW)

(73) Assignee: LIH YANN INDUSTRIAL CO., LTD., Taichung (TW)

( * ) Notice: Subject to any disclaimer, the term of this patent is extended or adjusted under 35 U.S.C. 154(b) by 355 days.

(21) Appl. No.: 13/937,877

(22) Filed: Jul. 9, 2013

(65) Prior Publication Data

US 2015/0017026 A1 Jan. 15, 2015

(51) Int. Cl.

| | |
|---|---|
| ***F04B 33/00*** | (2006.01) |
| ***F04B 39/14*** | (2006.01) |
| ***F04B 53/16*** | (2006.01) |
| ***F04F 5/14*** | (2006.01) |

(52) U.S. Cl.

CPC ..... *F04B 39/14* (2013.01); *F04B 33/00* (2013.01); *F04B 53/162* (2013.01); *F04F 5/14* (2013.01); *F04B 33/005* (2013.01)

(58) Field of Classification Search

CPC ..... F04B 39/14; F04B 53/162; F04B 33/00; F04F 5/14

USPC ..... 137/565.25

See application file for complete search history.

(56) References Cited

U.S. PATENT DOCUMENTS 1,108,903 A * 9/1914 Hancock ..... F04B 49/24 137/565.25
1,713,517 A * 5/1929 Boe ..... F16N 3/12 141/26
2,012,721 A * 8/1935 Johnson ..... F02N 99/006 137/565.25
5,002,154 A * 3/1991 Chen ..... F01M 11/045 141/27
6,357,492 B1 * 3/2002 Hsu ..... B67D 7/0205 137/565.25
6,484,744 B1 * 11/2002 Tseng ..... F01M 11/045 137/205
7,093,624 B2 * 8/2006 Chen ..... F04B 33/00 137/205
7,367,366 B2 * 5/2008 Liao ..... F04B 33/00 141/26
8,240,433 B2 * 8/2012 Tseng ..... F04B 9/14 184/1.5
8,360,741 B2 * 1/2013 Chuang ..... F04B 9/14 417/185
8,419,376 B2 * 4/2013 Sun ..... F04B 9/14 141/67
8,419,377 B2 * 4/2013 Hsu ..... F04B 9/14 141/67
9,046,113 B2 * 6/2015 Chuang ..... F04F 5/14

* cited by examiner

*Primary Examiner* — Nathan J Newhouse
*Assistant Examiner* — Christopher Bobish
(74) *Attorney, Agent, or Firm* — Muncy, Geissler, Olds & Lowe, P.C.

(57) ABSTRACT

A pump includes a cap that is fit into an opening of a pump body. The pump body has an external thread formed on an outer circumference close to a top face thereof for engagement with and coupling to a rotatable fixing ring having an internal thread so as to retain a cap from top side thereof. The threading engagement along the circumference fixes the cap and the pump body together. The cap has an underside from which a projecting ring extends downward. The projecting ring has a thread. A piston cylinder has an end forming a thread engageable with the thread of the projecting ring to complete the assembling of the piston cylinder.

6 Claims, 6 Drawing Sheets

STRUCTURE OF PUMP

BACKGROUND OF THE INVENTION

1. Field of the Invention

The present invention relates generally to the field of pump, and in particular to an improved structure of a pump that comprises a pump body having an opening into which a cap is fit and a rotatable fixing ring is used to secure and thus fix the pump body and the cap together, wherein the cap has an underside from which a projecting ring having a thread extends to engage a thread formed on an end of a piston cylinder to complete assembling so as to achieve the advantages of being easy to assemble and disassemble, reducing components and parts needed, reducing cost, and being applicable to various volumes of the pump.

2. The Related Arts

A variety of pumps are known. FIG. 1 of the attached drawings shows a pumping device that is disclosed in U.S. Pat. No. 7,367,366 own by the present inventor. The pumping device comprises a pump body 10 having a bottom to which a base 11 is mounted to receive a user's foot to step thereon and a top to which a cap 12 is mounted. The pump body 10 receives therein a frame 13 through which a piston cylinder 14 is received to allow an end thereof to connect to and communicate with a first transverse passage. A piston rod 15 extends through the cap 12 into the piston cylinder 14. The piston rod 15 has an end to which a piston disk assembly 151 is mounted. An internal one-way valve is arranged at an end of the first transverse passage located under the piston disk assembly 151 and an external one-way valve 103 is mounted to an opposite end of the first transverse passage. The cap 12 comprises a second transverse passage 121 formed in one side portion thereof and having an end receiving a steel sphere therein, an open end to which a nozzle 123 is mounted, and a middle portion that extends downward to form an upright tube that has an open end to which a manual-operation buoy-based safety valve 125 is mounted. The second transverse passage 121 has a portion that is exposed outside and is formed with an opening for connecting with a first slide valve 126. The first slide valve 126 is connected by an intermediate tube 18 with the external one-way valve 103 for communication therewith. The cap 12 comprises an air inlet valve that comprises an air inlet set 171 forming therein a T-shaped passage comprising an upper horizontal section connected to a control handle 173. The control handle 173 comprises spaced recesses, whereby through the handle being pulled out or pushed in, the spaced recesses may be registered or shifted away to thereby open or close the T-shaped passage of the inlet seat 171. The cap 12 comprises a third transverse passage 16 formed in another portion thereof and having two ends respectively coupled to a second slide valve 161 and a vacuum generator 162 and a further end coupled to a pressurized air control valve 163. The third transverse passage 16 comprises an opening to couple a pneumatic-operation buoy-based safety valve 164. The cap 12 comprises a large fluid opening 165. Through controlling the air inlet valve and the opening condition of the first slide valve 126, manual operation of the piston rod 15 for up and down movement causes vacuum generated inside the barrel to draw in a fluid or causes a rise of internal pressure for expelling the fluid contained in the barrel. Alternatively, pressurized air can be introduced therein and through the opening conditions of the first and second slide valves 126, 161, air contained in the barrel can be evacuated to induce vacuum inside the barrel for drawing in fluid or pressurized air may be introduced into the barrel to causes a rise of internal pressure for expelling fluid from the barrel.

However, such a known pumping device has a complicated structure that requires a large number of parts assembled together to form the pump. The cost is high and the assembling is difficult and time-consuming. Maintenance is also difficult.

For the known pumping device, skilled person is required for maintenance and repairing if components fail or are broken. General users are incapable of disassembling the device for carrying out part replacement. It may also be difficult for the skilled person, who successfully disassembles the device and carries out replacement of parts, to re-assemble the disassembled device. This is because the base and the cap are respectively set at opposite ends of the piston cylinder and to make a perfect positional calibration is in general very difficult. Furthermore, the frame and sealing rings are also necessarily mounted therebetween, where any incorrect positioning would damage the sealing rings or cause undesired leak. In addition, a number of bolts are needed for securing and fixing the components. All these steps of operation must be carried out in a very precise manner, otherwise the device might get destroyed. It is for such a reason that the consumers are encouraged to purchase a new one of the pumping device, instead of repairing of any broken parts for the repairing operation may cause further damage that requires the maintenance operator to pay for.

The known pumping device is of such a structure that the piston cylinder has a fixed length and thus the length of the base and the cap is fixed also for they are fixed to the two ends of the piston cylinder. The pump body is thus invariable in specification. This imposes a constraint on parts stock, unnecessarily increasing stress of parts stock and also increasing the parts inventory, thereby making it adverse for market competition.

Thus, it is desired to provide a solution for overcoming the above problems.

SUMMARY OF THE INVENTION

An object of the present invention is to provide an improved structure of a pump that comprises a pump body having an opening in which a cap is fit and a rotatable fixing ring that is mounted through threading engagement to fix the pump body and the cap together, wherein the cap has an underside from which a projecting ring having a thread extends to mate a thread formed at an end of a piston cylinder to complete assembling, whereby advantages of being easy to assemble and disassemble, reducing parts and components used, reducing cost, and being applicable to various volumes of the pump body can be achieved.

To achieve the above object, the present invention provides an improved structure of the pump, which comprises a pump body, which has a lower end to which a base is fixed; a cap, which is fit into an opening of the pump body; a rotatable fixing ring, which comprises an internal thread that is engageable with an external thread form on an outer circumference of the pump body close to a top of the pump body so that a top portion thereof is positionable on the cap and the threading engagement along the circumferences fixes the cap and the pump body together, wherein the cap has an inner side from which a projecting ring extends downwards and the projecting ring comprises an internal thread; a piston cylinder, which has an end that is closed and in a suspending condition and an opposite end comprising a thread engageable with and fixed to the thread of the projecting ring to complete the assembling of the piston cylinder. Assembling and disassembling and maintenance are easy. The cost is greatly reduced. A non-experienced person is also capable of carrying out maintenance operations. The parts and components needed are greatly reduced. The shape of the pump body is not limited. The cap and the rotatable fixing ring can be used to fix pumps of various capacities.

BRIEF DESCRIPTION OF THE DRAWINGS

The present invention will be apparent to those skilled in the art by reading the following description of a preferred embodiment thereof, with reference to the attached drawings, wherein.

DETAILED DESCRIPTION OF THE PREFERRED EMBODIMENT

The present invention provides an improved structure of a pump.

To allow the present invention to be fully understood in respect of objects, features, and functionality thereof, a detailed description will be given with reference to a preferred embodiment by referring to the attached drawings.

Figure 1:
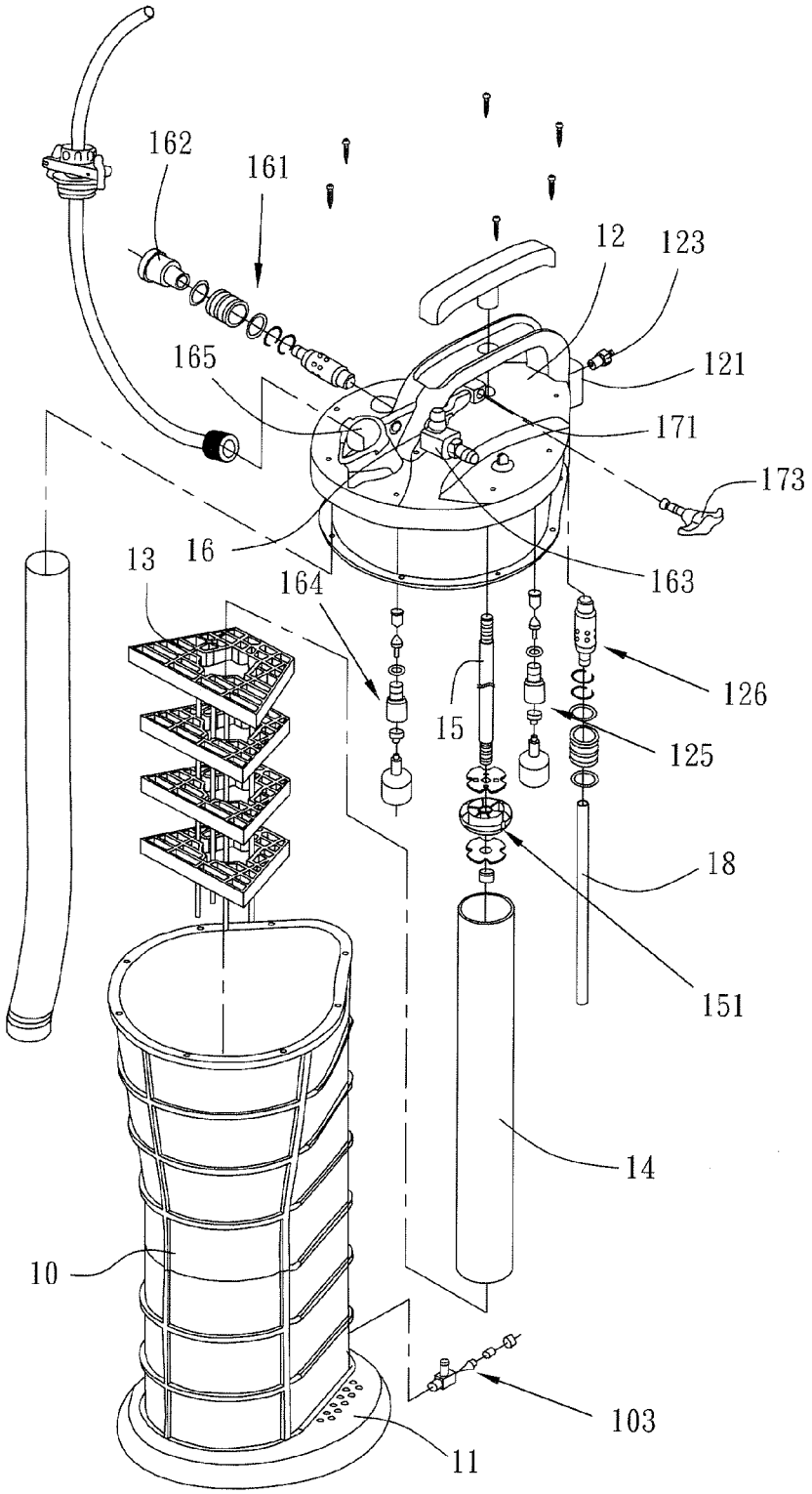
Prior Art Fig 1
FIG. 1 is an exploded view of a conventional pumping device.
Figure 2:
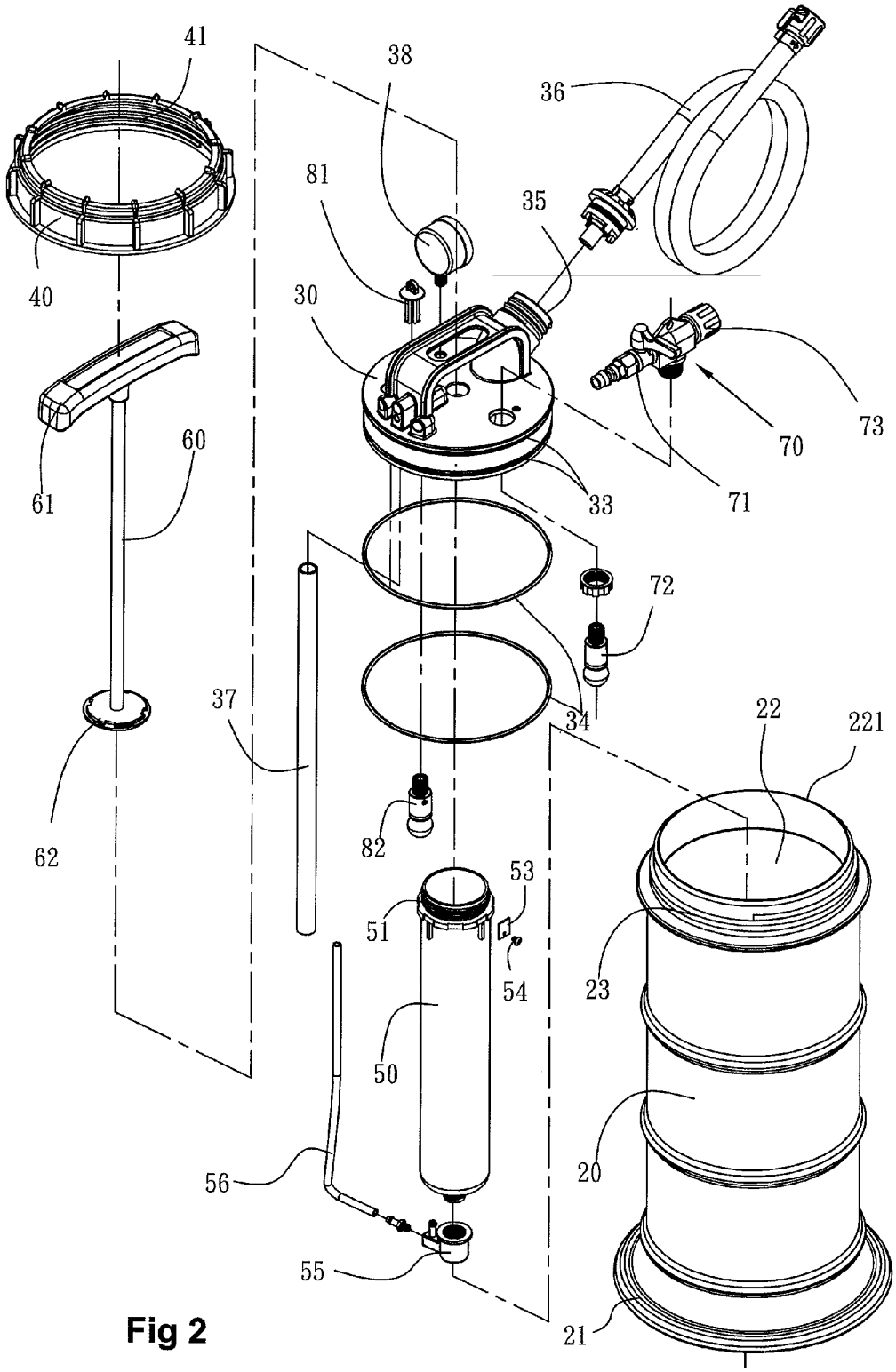
FIG. 2 is an exploded view of an embodiment of the present invention.
Figure 3:
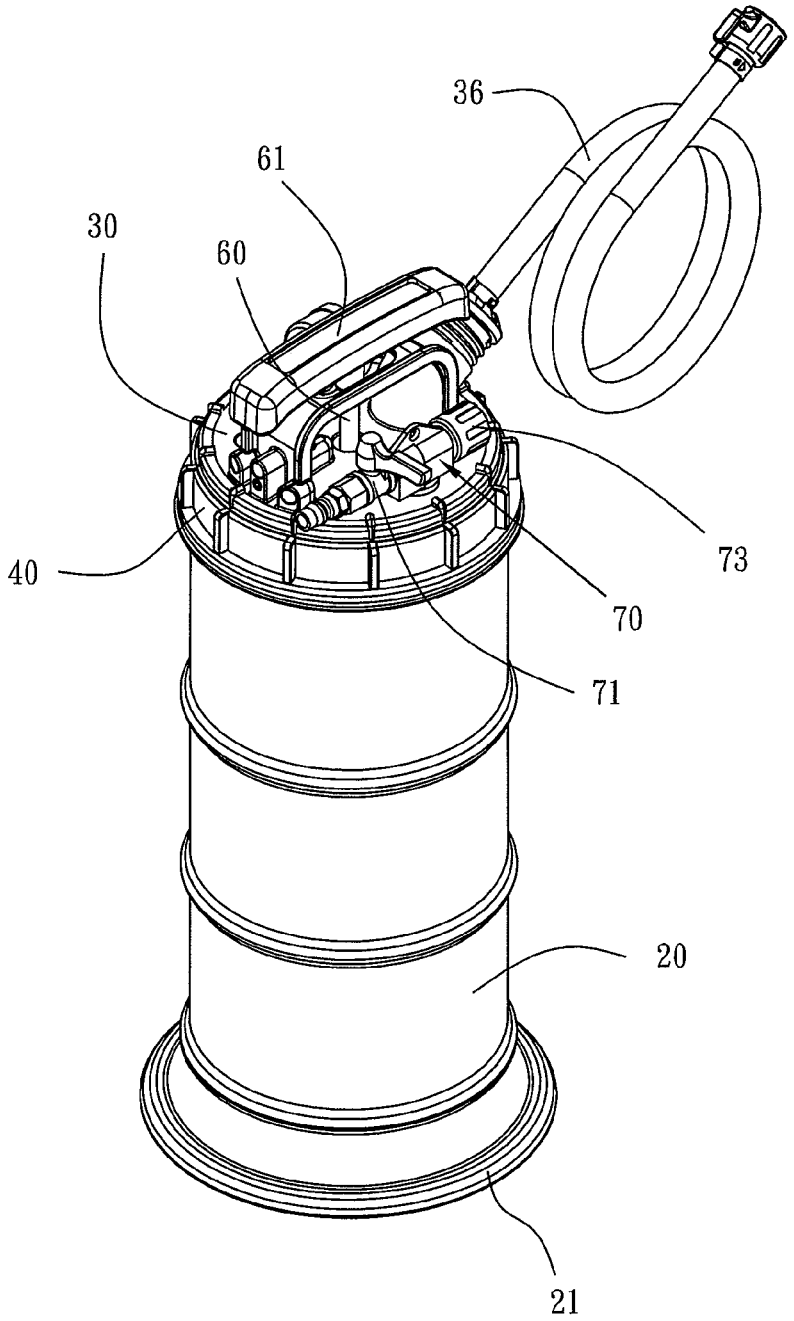
FIG. 3 is a perspective view of the embodiment of the present invention.

Referring to FIGS. 2 and 3, the present invention provides an improved structure of a pump that comprises the following components/parts:

a pump body 20, which has a bottom to which a base 21 is fixed;

a cap 30, which is sized to fit into an opening 22 of the pump body 20, the cap 30 having an inner side from which a projecting ring 31 (see FIG. 5) extends downwards, the projecting ring 31 comprising an internal thread 311, the cap 30 receiving, at a center thereof, a piston rod 60 to extend therethrough, the piston rod 60 having an end to which an operation handle 61 is fixed, the piston rod 60 having an opposite end to which a piston disk 62 is attached, the piston rod 60 extending through the projecting ring 31, the cap 30 comprising a fluid opening 35 formed in one side portion thereof, the fluid opening 35 being connectable to a fluid hose 36, the cap 30 being provided with a pneumatic assembly 70, an automatic over-pressure relief valve 81, a manual-operation buoy-based safety valve 82 mounted thereto;

a rotatable fixing ring 40, the pump body 20 comprising an external thread 23 formed on an outer circumference at a location close to a top face thereof, the rotatable fixing ring 40 comprising an internal thread 41 engageable with the external thread, whereby a top portion of the rotatable fixing ring 40 is positionable on the cap 30 and the internal and external threads 41, 23 formed on the circumferences mate each other to securely fix the cap 30 and the pump body 20 together; and a piston cylinder 50, which has an end that is closed and in a suspending condition, the piston cylinder 50 having an opposite end that is formed with an external thread 51 engageable with and thus fixed to the internal thread 311 of the projecting ring 31, after which the rotatable fixing ring 40 can be mounted to fix the cap 30 and the pump body 20 together to complete the assembling of the pump according to the present invention, whereby assembling and disassembling and maintenance of the pump are easy, the cost can be significantly reduced, maintenance can be conducted by a non-experienced person, the parts needed are reduced, the shape of the pump body is not unnecessarily constrained, and the cap and the rotatable fixing ring can be used to fix pumps of various capacities.

Figures 5, 5A:
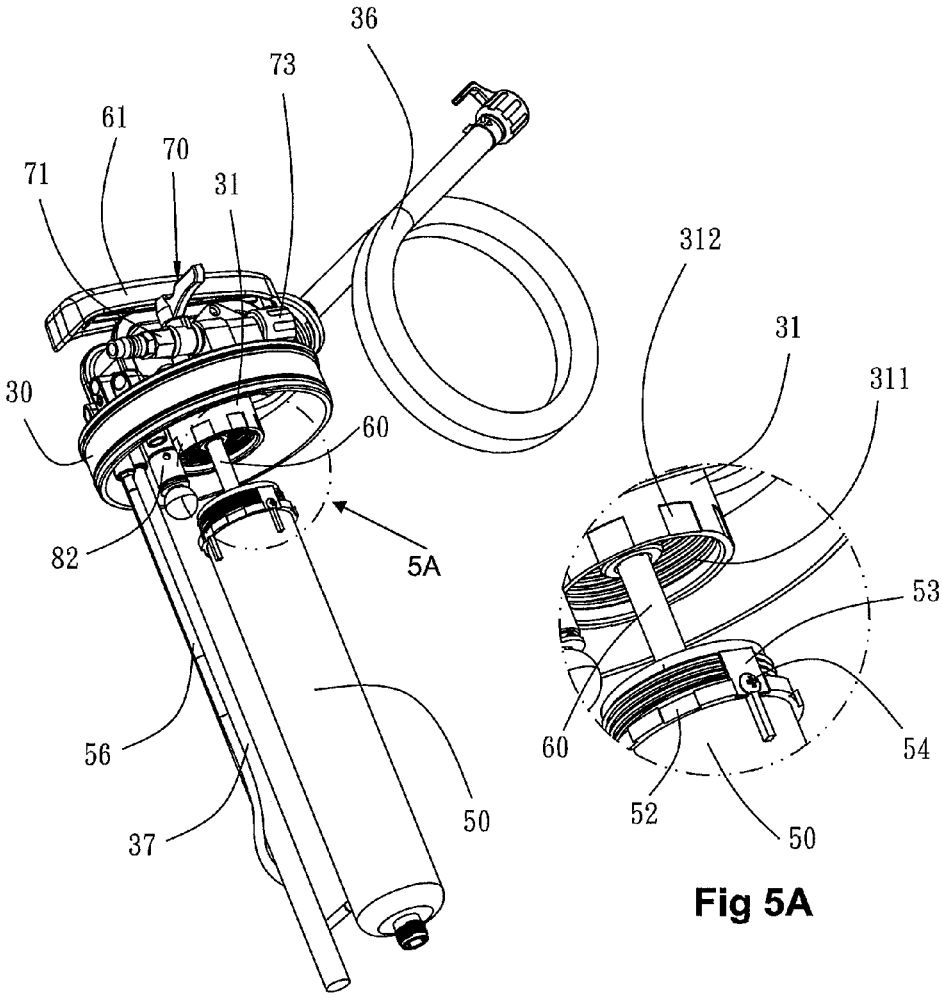
FIG. 5 is a perspective view illustrating an arrangement that prevents a piston cylinder according to the present invention from getting detached due to vibration.
FIG. 5A is an enlarged view of the circled portion 5A of FIG. 5.

Referring to FIG. 5, in the improved structure of the pump just discussed, the projecting ring 31 of the cap 30 has an outer circumferential surface in which a plurality of equally spaced recesses 312 is formed. The piston cylinder 50 has an outer circumferential surface in which a plurality of notches 52 is formed to correspond to the recesses 311. The piston cylinder 50 is mounted to the projecting ring 31 of the cap 30 by having the external thread 51 mating the internal thread 311 so that one of the notches 52 is exactly in registration with one of the recesses 312, whereby a locking plate 53, which is preferably a steel plate, can be simultaneously received in the notch 52 and the recess 312 and a screw 54 is applied to secure the locking plate 53 so as to prevent the piston cylinder 50 from being caused by vibration induced by operation thereof to separate from the cap 30.

Figure 4:
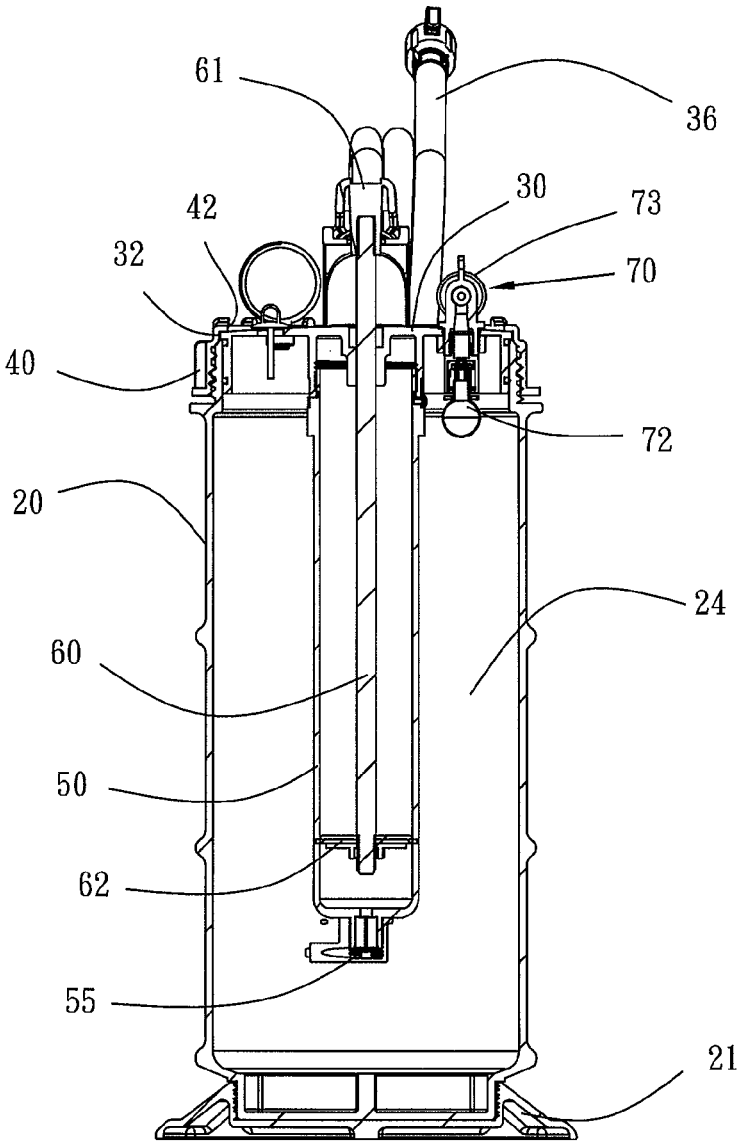
FIG. 4 is a cross-sectional view of the embodiment of the present invention.

Referring to FIG. 4, in the improved structure of the pump just discussed, the cap 30 comprises a circumferential flange 32 formed along a circumference thereof close to a top thereof. The top portion of the rotatable fixing ring 40 has an inner circumference from which a hold-down rim 42 projects inward. The circumferential flange 32 is positionable on a top face 221 of the opening 22 and the circumferential flange 32 is held down and fixed in position by the hold-down rim 42.

Referring to FIG. 2, in the improved structure of the pump just discussed, the cap 30 has an outer circumferential surface in which two circumferential grooves 33 are formed and the circumferential grooves 33 receive and hold therein two sealing rings 34.

Referring to FIGS. 3 and 4, in the improved structure of the pump just discussed, the pneumatic assembly 70 comprises a pressurized air control valve 71 that is connected to a pneumatic-operation buoy-based safety valve 72. The pneumatic-operation buoy-based safety valve 72 is connected to a vacuum generator 73. The pressurized air control valve 71 and the vacuum generator 73 are mounted to the top of the cap 30. The pneumatic-operation buoy-based safety valve 72 is mounted to an underside of the cap 30 to face toward a receiving space 24 formed in the pump body 20.

Referring to FIG. 2, in the improved structure of the pump just discussed, the underside of the cap 30 is provided with an article receiving tube 37 facing the receiving space 24 of the pump body 20 for temporarily receiving and holding therein various additional hoses and/or pipes during the use of the pump.

Referring to FIG. 2, in the improved structure of the pump just discussed, the cap 30 is provided, at the top thereof, with a pressure gauge 38, whereby the pressure gauge 38 is operable to detect internal pressure of the pump body 20.

Referring to FIG. 2, in the improved structure of the pump just discussed, the piston cylinder 50 has a lower end to which a one-way valve 55 is mounted. The one-way valve 55 is connected to an intermediate tube 56, and the intermediate tube 56 is connected to the cap 30 for communication with the outside.

Referring to FIGS. 3 and 4, in a pneumatic operation of fluid drawing with the pump according to the present invention, the pressurized air control valve 71 of the pneumatic assembly 70 is connected to a pressurized air supply so as to supply pressurized air through the vacuum generator 73 to make it generating vacuum suction power in the receiving space 24 of the pump body 20 thereby drawing an external supply of fluid, such as oil, through the fluid hose 36 into the receiving space. When the surface level of the fluid inside the receiving space reaches an upper limit, the surface of the fluid raises the pneumatic-operation buoy-based safety valve 72 to thereby interrupt the suction of the pneumatic assembly 70 so as to stop further drawing of the fluid.

Figure 6:
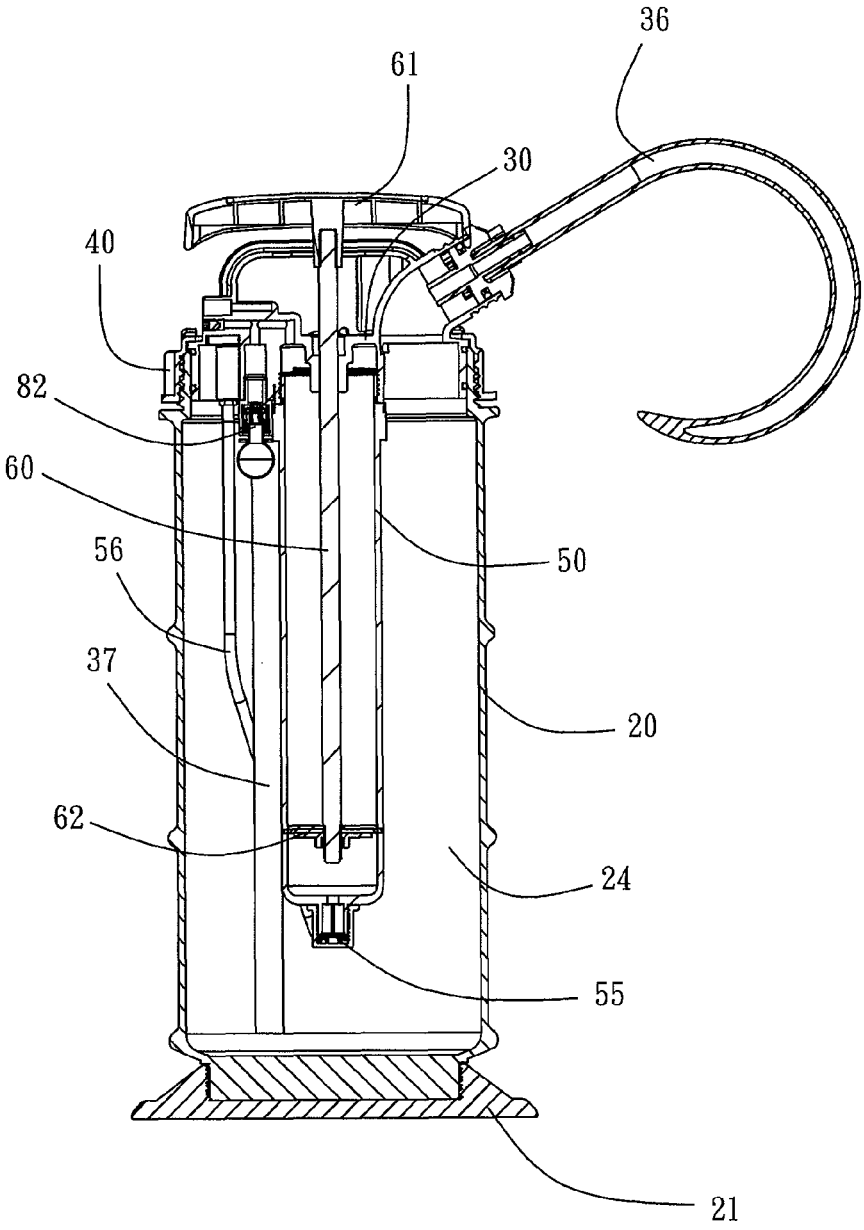
FIG. 6 is another cross-sectional view of the embodiment of the present invention.

Referring to FIG. 6, in a manual operation of fluid drawing with the pump according to the present invention, air contained in the receiving space 24 of the pump body 20 is forced to pass through the manual-operation buoy-based safety valve 82 into the piston cylinder 50. This is done by manually operating the operation handle 61 to drive the piston rod 60 and the piston disk 62 to force the air to move through the one-way valve 55 mounted at the lower end of the piston cylinder 50 to further move through the intermediate tube 56 to be expelled out of the pump body 20, thereby inducing vacuum inside the receiving space 24 of the pump body 20 and the external supply of fluid is drawn through the fluid hose 36 into the receiving space. When the surface level of the fluid inside the receiving space reaches an upper limit, the surface of the fluid moves the manual-operation buoy-based safety valve 82 upward to thereby interrupt the suction of the piston cylinder 50 so as to stop further drawing of the fluid.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A pump, comprising:

a pump body, which has a bottom to which a base is fixed;

a cap, which is sized to fit into an opening of the pump body, the cap having an inner side from which a projecting ring extends downwards, the projecting ring comprising an internal thread, the cap receiving, at a center thereof, a piston rod to extend therethrough, the piston rod having an end to which an operation handle is fixed, the piston rod having an opposite end to which a piston disk is attached, the piston rod extending through the projecting ring, the cap comprising a fluid opening formed in one side portion thereof, the fluid opening being connectable to a fluid hose, the cap being provided with a pneumatic assembly, an automatic over-pressure relief valve, a manual-operation buoy-based safety valve mounted thereto;

a rotatable fixing ring, the pump body comprising an external thread formed on an outer circumference thereof at a location close to a top face thereof, the rotatable fixing ring comprising an internal thread formed on an inner circumferential surface thereof engageable with the external thread, whereby a top portion of the rotatable fixing ring is positionable on the cap and the internal thread of the fixing ring and the external thread of the pump body formed on the respective circumferential surfaces mate with each other to securely fix the cap and the pump body together; and a piston cylinder, which has an end that is closed and in a suspended condition, the piston cylinder having a lower end to which a one-way valve is mounted, the one-way valve being connected to an intermediate tube, the intermediate tube being connected to the cap for communication with the outside, the piston cylinder having an opposite end that is formed with an external thread engageable with and thus fixed to the internal thread of the projecting ring, after which the rotatable fixing ring is then mounted to fix the cap and the pump body together to complete the assembling of the pump, the projecting ring of the cap having an outer circumferential surface in which a plurality of equally spaced recesses is formed, the piston cylinder having an outer circumferential surface in which a plurality of notches is formed to correspond to the recesses, the piston cylinder being mounted to the projecting ring of the cap by having the external thread of the piston cylinder mating with the internal thread of the projecting ring so that one of the notches is in registration with one of the recesses, whereby a locking plate is simultaneously receivable in the notch and the recess and a fastener is applied to secure the locking plate so as to prevent the piston cylinder from being caused by vibration induced by operation thereof to separate from the cap.

2. The pump as claimed in claim 1, wherein the cap comprises a circumferential flange formed along a circumference thereof close to a top thereof and the top portion of the rotatable fixing ring has an inner circumference from which a hold-down rim projects inward, the circumferential flange being positionable on a top face of the opening, the circumferential flange being held down and fixed in position by the hold-down rim.

3. The pump as claimed in claim 1, wherein the cap has an outer circumferential surface in which two circumferential grooves are formed and the circumferential grooves receive and hold therein two sealing rings.

4. The pump as claimed in claim 1, wherein the pneumatic assembly comprises a pressurized air control valve that is connected to a pneumatic-operation buoy-based safety valve, which is connected to a vacuum generator, the pressurized air control valve and the vacuum generator being mounted to a top of the cap, the pneumatic-operation buoy-based safety valve being mounted to an underside of the cap to face toward a receiving space formed in the pump body.

5. The pump as claimed in claim 4, wherein the underside of the cap is provided with an article receiving tube facing the receiving space of the pump body.

6. The pump as claimed in claim 1, wherein the cap is provided, at a top thereof, with a pressure gauge that detects internal pressure of the pump body.

* * * * *